US011069955B2

(12) United States Patent
Ying et al.

(10) Patent No.: US 11,069,955 B2
(45) Date of Patent: Jul. 20, 2021

(54) ANTENNA OF MOBILE TERMINAL AND MOBILE TERMINAL

(71) Applicant: HUAWEI TECHNOLOGIES CO., LTD., Guangdong (CN)

(72) Inventors: Lijun Ying, Shanghai (CN); Hanyang Wang, Reading (GB); Liang Xue, Shanghai (CN); Jiaqing You, Shanghai (CN); Chien-Ming Lee, Shanghai (CN); Xiaoli Yang, Shanghai (CN); Dong Yu, Shanghai (CN); Lei Wang, Shanghai (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/495,806

(22) PCT Filed: Jun. 16, 2017

(86) PCT No.: PCT/CN2017/088683
§ 371 (c)(1),
(2) Date: Sep. 19, 2019

(87) PCT Pub. No.: WO2018/171057
PCT Pub. Date: Sep. 27, 2018

(65) Prior Publication Data

US 2020/0099125 A1 Mar. 26, 2020

(30) Foreign Application Priority Data

Mar. 20, 2017 (CN) ..... 201710166832.4

(51) Int. Cl.
*H01Q 1/48* (2006.01)
*H01Q 1/24* (2006.01)
(Continued)

(52) U.S. Cl.
CPC ..... *H01Q 1/243* (2013.01); *H01Q 1/48* (2013.01); *H01Q 1/50* (2013.01); *H01Q 5/371* (2015.01); *H01Q 5/378* (2015.01); *H01Q 9/045* (2013.01)

(58) Field of Classification Search
CPC ..... H01Q 1/243; H01Q 5/371; H01Q 5/378; H01Q 1/48; H01Q 1/50; H01Q 9/045
See application file for complete search history.

(56) References Cited

U.S. PATENT DOCUMENTS

2010/0060530 A1 3/2010 Shoji
2016/0064820 A1 3/2016 Kim et al.
(Continued)

FOREIGN PATENT DOCUMENTS

CN 101714698 A 5/2010
CN 103094690 A 5/2013
(Continued)

OTHER PUBLICATIONS

Liwan Zhang,"Research on The Thechnology of Antennas for Metal-ring-frame Smartphone Applications",University of Electronic Science and Technology of China, Electromagnetic Field and Microwave Technology, 2015,total 75 pages.
(Continued)

*Primary Examiner* — Graham P Smith
(74) *Attorney, Agent, or Firm* — Womble Bond Dickinson (US) LLP

(57) ABSTRACT

An antenna of a mobile terminal is provided. At least two slots are disposed in a metal bezel of the mobile terminal, and the two slots divide the metal bezel into a first metal section, a second metal section, and a third metal section. A radiating element of the antenna includes the second metal section located between the two slots, a first conductor, and a second conductor. The first conductor and the second
(Continued)

conductor are separately connected to the second metal section. A feed point is connected to the first conductor by using a matching network. A ground point is connected to the second conductor to form a loop antenna. An electrical length path of current from the feed point to the second metal section is not equal to an electrical length path of current from the ground point to the second metal section.

20 Claims, 5 Drawing Sheets

(51) Int. Cl.

| | |
|---|---|
| ***H01Q 5/371*** | (2015.01) |
| ***H01Q 5/378*** | (2015.01) |
| ***H01Q 1/50*** | (2006.01) |
| ***H01Q 9/04*** | (2006.01) |

(56) References Cited

U.S. PATENT DOCUMENTS

| | | | | |
|---|---|---|---|---|
| 2016/0112551 | A1 | 4/2016 | Hung et al. | |
| 2016/0164181 | A1 | 6/2016 | Huang et al. | |
| 2016/0233574 | A1* | 8/2016 | Xiong | H01Q 1/24 |
| 2017/0005394 | A1 | 1/2017 | Wang et al. | |
| 2017/0170562 | A1 | 6/2017 | Lee et al. | |
| 2017/0346159 | A1* | 11/2017 | Xue | H01Q 1/24 |
| 2017/0373388 | A1 | 12/2017 | Wang et al. | |
| 2018/0166769 | A1* | 6/2018 | Chang | H01Q 1/24 |

FOREIGN PATENT DOCUMENTS

| | | | | | |
|---|---|---|---|---|---|
| CN | 103117452 | A | | 5/2013 | |
| CN | 103296385 | A | | 9/2013 | |
| CN | 104638343 | A | | 5/2015 | |
| CN | 204596970 | U | | 8/2015 | |
| CN | 105305066 | A | | 2/2016 | |
| CN | 105305067 | A | | 2/2016 | |
| CN | 105514624 | A | | 4/2016 | |
| CN | 105703790 | A | | 6/2016 | |
| CN | 105789831 | A | | 7/2016 | |
| CN | 105811103 | A | | 7/2016 | |
| CN | 105826661 | A | | 8/2016 | |
| CN | 105826679 | A | | 8/2016 | |
| CN | 105932408 | A | | 9/2016 | |
| CN | 105958201 | A | * | 9/2016 | H01Q 5/10 |
| CN | 105977614 | A | | 9/2016 | |
| CN | 106299607 | A | | 1/2017 | |
| CN | 106384870 | A | | 2/2017 | |
| CN | 106412161 | A | | 2/2017 | |
| CN | 106450745 | A | * | 2/2017 | H01Q 1/24 |
| CN | 106450745 | A | | 2/2017 | |
| CN | 106450746 | A | | 2/2017 | |
| GB | 2520228 | A | | 5/2015 | |
| JP | 2016506636 | A | | 3/2016 | |
| KR | 20140126079 | A | | 10/2014 | |
| KR | 20160104482 | A | | 9/2016 | |
| WO | 2008013021 | A1 | | 1/2008 | |
| WO | 2015117483 | A1 | | 8/2015 | |
| WO | 2016106779 | A1 | | 7/2016 | |

OTHER PUBLICATIONS

Pengpeng Li,"Design of Full Metal Boundary Smartphone Antennas",University of Electronic Science and Technology of China, Electromagnetic Field and Microwave Technology, 2015,total 71 pages.

* cited by examiner

ANTENNA OF MOBILE TERMINAL AND MOBILE TERMINAL

This application claims priority to Chinese Patent Application No. 201710166832.4, filed with the Chinese Patent Office on Mar. 20, 2017, and entitled "ANTENNA", which is incorporated by reference in its entirety and a national stage of International Application No. PCT/CN2017/088683, filed on Jun. 16, 2017, which claims priority to Chinese Patent Application No. 201710166832.4, filed on Mar. 20, 2017. Both of the aforementioned applications are hereby incorporated by reference in their entireties.

TECHNICAL FIELD

This application relates to the field of communications technologies, and in particular, to an antenna of a mobile terminal.

BACKGROUND

A principle of a conventional T-type antenna is shown in FIG. 1. It can be learned from FIG. 1 that the T-type antenna uses a metal bezel as a radiating element of the antenna, and at least two slots are disposed in the metal bezel. The slots divide the metal bezel into three metal sections, and the three metal sections are marked as a first metal section 1, a second metal section 2, and a third metal section 3, respectively. The second metal section 2 is connected to a feed point 4. During connection, the feed point 4 is connected to the second metal section 2 by using a matching network. A current of the T-type antenna is distributed along a metal bezel of a mobile terminal. Refer to FIG. 2*a* to FIG. 2*d*. FIG. 2*a* is a schematic diagram of distribution of a maximum electric-field value in a quarter wavelength modal of a long stub running from a feed to a left slot; FIG. 2*b* is a schematic diagram of distribution of a maximum electric-field value in one wavelength modal of an entire stub, namely, a second metal section 2; FIG. 2*c* is a schematic diagram of distribution of a maximum electric-field value in a quarter wavelength modal of a short stub running from a feed to a right slot; and FIG. 2*d* is a schematic diagram of distribution of a maximum electric-field value in a three-quarter wavelength modal of a long stub running from a feed to a left slot. A circle represents a maximum electric field point in a corresponding modal. It can be learned from FIG. 2*a* to FIG. 2*d* that the maximum electric field point in each modal is usually at a slot of the metal bezel. As a result, antenna load is relatively large, and a radiating hole is small, causing low bandwidth and radiating efficiency. This is even more serious in a case of a large screen-to-body ratio and small headroom. In addition, an antenna slot is usually disposed close to an edge of the metal bezel to implement low-frequency resonance. As a result, a large electric-field area is relatively close to a hand, and impact of the hand on the antenna is relatively large.

SUMMARY

Embodiments of this application provide an antenna of a mobile terminal, to improve performance of the antenna of the mobile terminal.

According to a first aspect, an antenna of a mobile terminal is provided, where the mobile terminal has a metal bezel, at least two slots are disposed in the metal bezel, and the two slots divide the metal bezel into a first metal section, a second metal section, and a third metal section; and the antenna includes a radiating element, a matching network, a feed point, and a ground point, where the radiating element includes the second metal section located between the two slots, a first conductor, and a second conductor; the first conductor is connected to one end of the second metal section, and a connection point between the first conductor and the second metal section is a feed contact point; the second conductor is connected to the other end of the second metal section, and a connection point between the second conductor and the second metal section is a ground contact point; and a vertical distance between the feed point and the ground point is less than a vertical distance between the feed contact point and the ground contact point;

the feed point is connected to the first conductor by using the matching network;

the ground point is connected to the second conductor; and an electrical length path of a current from the feed point to the second metal section is not equal to an electrical length path of a current from the ground point to the second metal section.

In the foregoing technical solutions, lengths of the first conductor and the second conductor are changed, so that the electrical length path of the current from the feed point to the second metal section is not equal to the electrical length path of the current from the ground point to the second metal section, and a maximum electric field point in each modal is far away from a slot of the metal bezel, thereby reducing electric-field load in the slot and impact of a hand on the electric field in the modal, and improving performance of the antenna.

In one embodiment, the feed point is connected to the first conductor by using the matching network. The matching network may include an electric control switch, a variable capacitor, a capacitor, and an inductor that are connected in parallel or in series.

During configuration, the feed point and the ground point may be respectively located on two sides of a central line, or the feed point and the ground point may be located on one side of a central line, and the central line is a central line, perpendicular to a length direction of the second metal section, among central lines of the second metal section.

In one embodiment, an adjusting circuit located between the ground point and the feeder is further included, and the adjusting circuit includes a plurality of parallel branches, an inductor or a capacitor is disposed on each branch, and each branch is grounded; and the second metal section is selectively connected to one branch of the adjusting circuit. An effective electrical length of the antenna may be changed by disposing the adjusting circuit, to tune a resonance frequency of the antenna. During configuration, one switch is disposed on each branch, or a single-pole multi-throw switch is used to implement a connection between the ground point and one branch.

In one embodiment, an inductor and a capacitor that are connected in series are disposed on at least one branch. An effective electrical length of the antenna may be changed by changing a value of the inductor or the capacitor, to tune a resonance frequency of the antenna.

In one embodiment, an adjusting circuit is disposed in the second conductor, the adjusting circuit includes a plurality of parallel branches, an inductor is disposed on each branch, and each branch is connected to the ground point; and the second metal section is selectively connected to one branch of the adjusting circuit. An effective electrical length of the antenna may be changed by disposing the adjusting circuit, to tune a resonance frequency of the antenna. During configuration, one switch is disposed on each branch, or a single-pole multi-throw switch is used to implement a connection between the ground point and one branch.

In one embodiment, an inductor and a capacitor that are connected in series are disposed on at least one branch. An effective electrical length of the antenna may be changed by changing a value of the inductor or the capacitor, to tune a resonance frequency of the antenna.

In one embodiment, the antenna further includes one or two parasitic elements, and the parasitic elements may include the first metal section or the third metal section that is grounded. A resonance frequency of the parasitic element may be tuned by the ground point.

In one embodiment, the parasitic element is the first metal section, or the third metal section, or the first metal section and a metal patch disposed at a slot endpoint of the first metal section, or the third metal section and a metal patch disposed on a slot endpoint of the third metal section.

In one embodiment, the metal patch is a flexible circuit board, a metal conductive plate, a laser layer, or a thin-layer conductor.

In one embodiment, the first conductor and the second conductor are connected by using a third conductor different from the second metal section, and the third conductor is a flexible circuit board, a metal conductive plate, a laser layer, or a thin-layer conductor.

According to a second aspect, a mobile terminal is provided, where the mobile terminal includes a metal bezel, at least two slots are disposed in the metal bezel, and the two slots divide the metal bezel into a first metal section, a second metal section, and a third metal section that are insulated from each other; and the mobile terminal further includes the antenna according to any one of the foregoing embodiments.

In the foregoing technical solutions, lengths of the first conductor and the second conductor are changed, so that the electrical length path of the current from the feed point to the second metal section is not equal to the electrical length path of the current from the ground point to the second metal section, and a maximum electric field point in each modal is far away from a slot of the metal bezel, thereby reducing electric-field load in the slot and impact of a hand on the electric field in the modal, and improving performance of the antenna.

DESCRIPTION OF EMBODIMENTS

The following clearly and completely describes the technical solutions in embodiments of this application with reference to the accompanying drawings in the embodiments of this application.

An antenna provided in the embodiments is applied to a mobile terminal. The mobile terminal may be a common mobile terminal device, such as a mobile phone or a tablet computer. In addition, the mobile terminal device has a metal bezel, and at least two slots are disposed in the metal bezel, thereby dividing the metal bezel into a plurality of metal sections that are insulated from each other. In the embodiments, as shown in FIG. 3, two slots are disposed in a metal bezel, and the two slots divide the metal bezel into a first metal section 50, a second metal section 22, and a third metal section 60.

Figure 3:
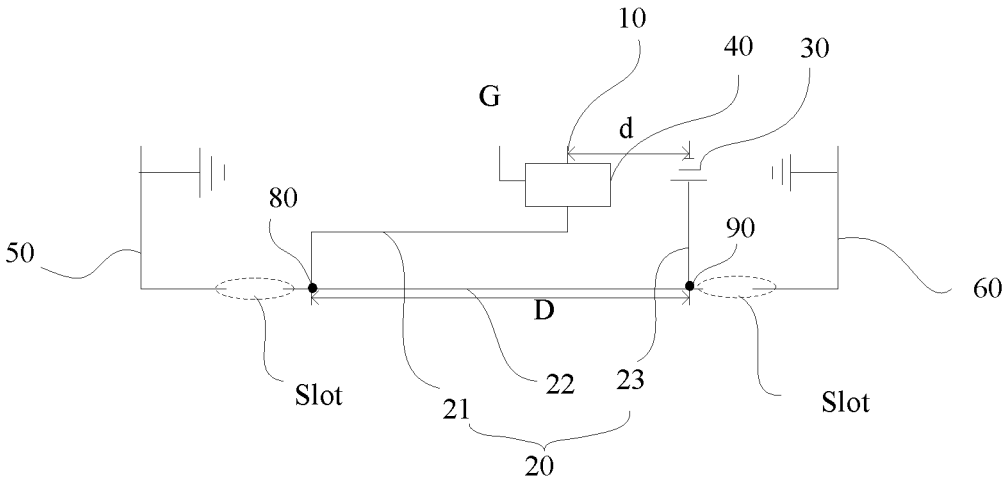
FIG. 3 is a schematic structural diagram of an antenna according to an embodiment of this application.

Still referring to FIG. 3, the antenna provided in the embodiments includes a radiating element 20, a matching network 40, a feed point 10, and a ground point 30. One end of the radiating element 20 is connected to the feed point 10 by using the matching network, and the other end is connected to the ground point 30. During connection, as shown in FIG. 3, the radiating element 20 includes three parts: the second metal section 22, a first conductor 21, and a second conductor 23. During connection, the first conductor 21 and the second conductor 23 are respectively connected to two ends of the second metal section 22. In one embodiment, the first conductor 21 is connected to one end of the second metal section 22, and the second conductor 23 is connected to the other end of the second metal section 22. The end of the second metal section 22 indicates an end where the second metal section 22 is close to a slot, and the end is a metal section with a particular length (such as less than 5 mm). The first conductor 21 and the second conductor 23 may be connected to any position of the metal section. A connection point between the first conductor 21 and the second metal section 22 is a feed contact point 80, and a connection point between the second conductor 23 and the second metal section 22 is a ground contact point 90. Still referring to FIG. 3, it can be learned from FIG. 3 that a vertical distance d between the feed point 10 and the ground point 30 is less than a vertical distance D between the feed contact point 80 and the ground contact point 90. In one embodiment, the vertical distance d between the feed point 10 and the ground point 30 is far less than the vertical distance D between the feed contact point 80 and the ground contact point 90. For example, a ratio between d and D is between 1/5 and 1/2. It should be understood that the ratio is only used for describing a great difference between d and D, instead of a direct correspondence. When this manner is used, a formed antenna may be applied to different frequency bands, and performance of the antenna is further improved.

As shown in FIG. 3, the feed point 10 and the ground point 30 are located on a same side of the second metal section 22, and the first conductor 21, the second conductor 23, and the second metal section 22 form a loop with an opening, thereby forming a loop antenna. During configuration, an electrical length path (a length of a path through which an electric charge flows from one point to another point) from the feed point 10 to the second metal section 22 is different from an electrical length path from the ground point 30 to the second metal section 22. In other words, an electrical length path of a current from the feed point 10 to the second metal section 22 is not equal to an electrical length path of a current from the ground point 30 to the second metal section 22.

Figure 1:
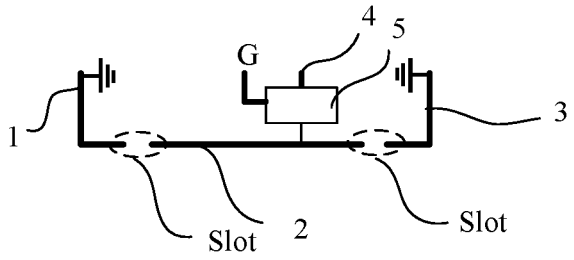
FIG. 1 shows a structure of an antenna of a mobile terminal in the prior art.
Figure 2A:
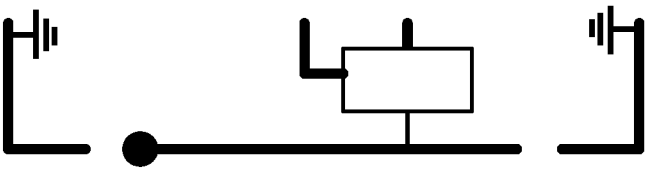
FIG. 2*a* to FIG. 2*d* are schematic diagrams of distribution of maximum electric-field values in modals with different frequency bands for the antenna shown in FIG. 1.
Figure 2B:
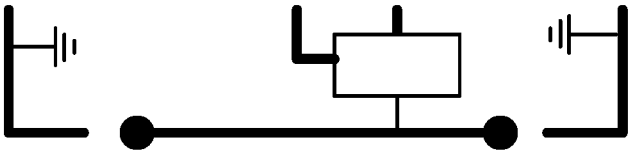
Figure 2C:
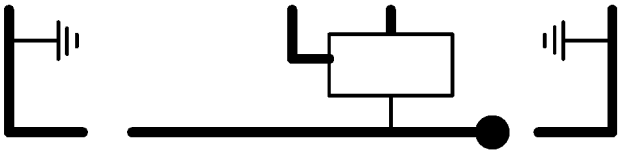
Figure 2D:
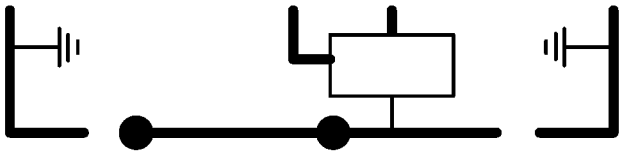

FIG. 2*a* to FIG. 2*d* are schematic diagrams of distribution of a maximum electric field of a conventional T-type antenna. FIG. 2*a* is a schematic diagram of distribution of a maximum electric-field value in a quarter wavelength modal of a long stub; FIG. 2*b* is a schematic diagram of distribution of a maximum electric-field value in one wavelength modal of an entire stub; FIG. 2*c* is a schematic diagram of distribution of a maximum electric-field value in a quarter wavelength modal of a short stub; and FIG. 2*d* is a schematic diagram of distribution of a maximum electric-field value in a three-quarter wavelength modal of a long stub. It can be learned from FIG. 2*a*, FIG. 2*b*, FIG. 2*c*, and FIG. 2*d* that when the prior-art T-type antenna uses the modes, a maximum electric-field point is located in the slot. As a result, a large electric-field area is relatively close to a hand, and impact of the hand on the antenna is relatively large, affecting performance of the antenna.

However, in this application, the electrical length paths from the feed point 10 to the second metal section 22 and from the ground point 30 to the second metal section 22 are changed, so that a maximum electric field point in each modal is far away from a slot of the metal bezel, thereby reducing electric-field load in the slot and impact of a hand on the electric field in the modal, and improving performance of the antenna. During change, the electrical length path from the feed point 10 to the second metal section 22 may be changed by changing a length of the first conductor 21, so that the electrical length path from the feed point 10 to the second metal section 22 is not equal to the electrical length path from the ground point 30 to the second metal section 22. Alternatively, the electrical length path from the ground point 30 to the second metal section 22 may be changed by changing a length of the second conductor 23, so that the electrical length path from the ground point 30 to the second metal section 22 is not equal to the electrical length path from the feed point 10 to the second metal section 22. Alternatively, lengths of both the first conductor 21 and the second conductor 23 may be changed, so that the electrical length path from the feed point 10 to the second metal section 22 is not equal to the electrical length path from the ground point 30 to the second metal section 22. Alternatively, a parallel adjusting circuit 80 may be used, so that the electrical length path from the feed point 10 to the second metal section 22 is not equal to the electrical length path from the ground point 30 to the second metal section 22. Alternatively, a series or parallel adjusting circuit 80 may be used, so that the electrical length path from the feed point 10 to the second metal section 22 is not equal to the electrical length path from the ground point 30 to the second metal section 22. For easy understanding of the foregoing different changing manners, the following describes in detail the antenna provided in the embodiments of this application with reference to the accompanying drawings.

Embodiment 1

Still referring to FIG. 3, two slots are disposed in a metal bezel of a mobile terminal provided in this embodiment, and the two slots divide the metal bezel into three metal sections that are insulated from each other. Metal sections that are located on two sides of the two slots are a first metal section 50 and a third metal section 60, and a metal section located between the two slots is a second metal section 22. As shown in FIG. 3, the second metal section 22 is a straight strip-shaped metal section. An antenna of the mobile terminal includes: a radiating element 20, a matching network 40, a feed point 10, and a ground point 30. The radiating element 20 includes the second metal section 22, and a first conductor 21 and a second conductor 23 that are connected to the second metal section 22. The first conductor 21 is a conductor in any form, such as a straight line form or a bend line form. In addition, the first conductor 21 and the second metal section 22 form a loop. In one embodiment, the first conductor 21 may be a flexible circuit board, a metal conductive plate, a laser layer, a thin-layer conductor, or the like. Alternatively, the first conductor 21 may be in any other form that can implement an electrical connection between the feed point 10 and the second metal section 22.

During configuration, as shown in FIG. 3, in this embodiment, the feed point 10 and the ground point 30 are located on one side of a central line, and the central line is a central line, perpendicular to a length direction of the second metal section 22, among central lines of the second metal section 22. If the mobile terminal is a mobile phone, a corresponding location of the central line is a location of a USB interface or a charging interface. Therefore, it may also be understood as that the feed point 10 and the ground point 30 are located on a same side of the USB interface or the charging interface. In this manner, it may be understood as when an electrical length path from the feed point 10 to a middle point of the second metal section 22 is equal to an electrical length path from the ground point 30 to the middle point of the second metal section 22, the location of the feed point 10 is changed to increase a physical distance between the feed point 10 and the middle point of the second metal section 22, and the feed point 10 and the second metal section 22 are connected by using the first conductor 21. In one embodiment, a length of the first conductor 21 is increased, so that the electrical length path from the feed point 10 to the second metal section 22 is greater than the electrical length path from the ground point 30 to the second metal section 22. This manner may be understood as lengths of the first conductor 21 and the second conductor 23 are changed, so that the electrical length path from the feed point 10 to the second metal section 22 is not equal to the electrical length path from the ground point 30 to the second metal section 22.

In this embodiment, as shown in FIG. 3, the feed point 10 is connected to the first conductor 21 by using the matching network 40. The matching network 40 may have different matching manners including a conductor and a capacitor, such as a plurality of conductors connected in parallel, a plurality of capacitors connected in series, or a conductor and a capacitor connected in series. A manner may be selected based on an actual requirement. In addition, the electrical length path from the feed point 10 to the middle point of the second metal section 22 may also be regulated by using the disposed matching network 40.

Embodiment 2

Figure 4:
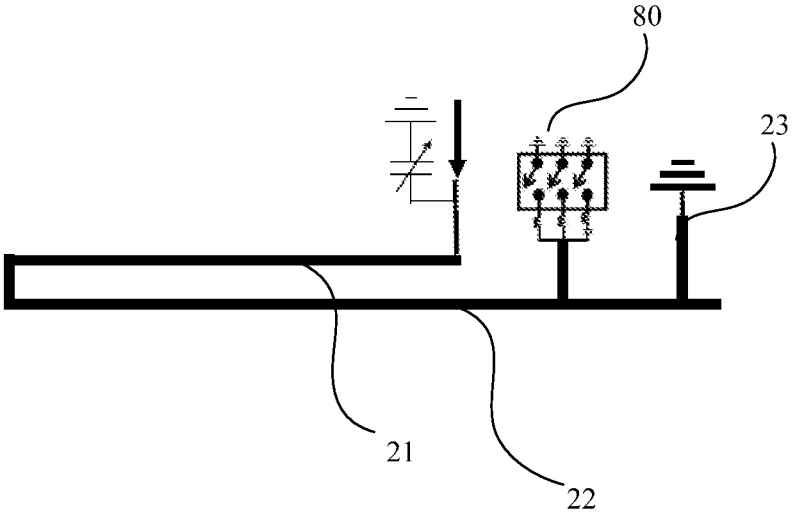
FIG. 4 is a schematic structural diagram of parallel-resonance electrical tilt of an antenna according to an embodiment of this application.
Figure 5:
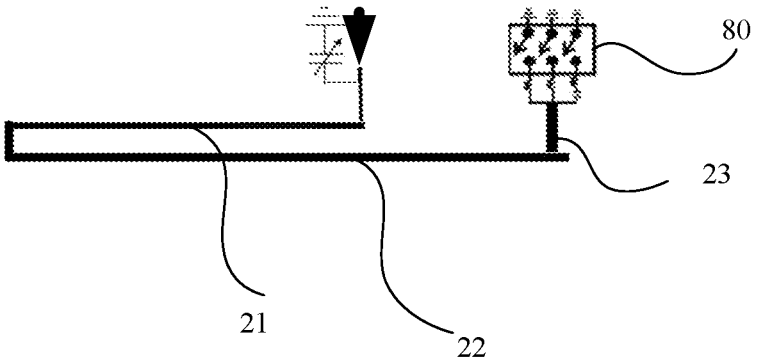
FIG. 5 is a schematic structural diagram of series-resonance electrical tilt of an antenna according to an embodiment of this application.

Referring to FIG. 4 and FIG. 5, in solutions shown in FIG. 4 and FIG. 5, the electrical length path from the ground point 30 to the second metal section 22 is changed. During change, the ground point 30 is connected in series or in parallel to a reference element, so as to change the electrical length path from the ground point 30 to a middle point of the second metal section 22.

FIG. 4 shows a manner in which the ground point 30 is connected to the reference element in parallel. In this case, the antenna further includes an adjusting circuit 80 located between the ground point 30 and the feed point. The adjusting circuit 80 is a circuit including the reference element. In one embodiment, the adjusting circuit 80 includes a plurality of branches connected in parallel, an inductor, a capacitor, or a combination of an inductor and a capacitor is disposed on each branch, and each branch is grounded. During configuration, as shown in FIG. 4, the plurality of branches are connected in parallel, one end of each of the plurality of branches is connected to the second metal section 22 in series, and the other end is grounded. In addition, during connection, the second metal section 22 is selectively connected to one branch of the adjusting circuit 80. As shown in FIG. 4, one switch is disposed on each branch. The switch is controlled to be switched on or off, to implement grounding of the second metal section 22 by using a branch in which a switch is switched on. In addition, a single-pole multi-throw switch may alternatively be used. In this case, a non-movable end of the single-pole multi-throw switch is connected to the second metal section 22, and a movable end is connected to the branch. By using the single-pole multi-throw switch, one branch is selected for grounding. In the foregoing manner, because the matching circuit 80 is connected to the ground point 30 in parallel, the electrical length path is changed by regulating the reference element disposed on the branch, so that the electrical length path from the feed point 10 to the second metal section 22 is not equal to the electrical length path from the ground point 30 to the second metal section 22.

The reference element may be the inductor or a circuit of the inductor and the capacitor that are connected in series. As shown in FIG. 4, a different inductor is disposed on each of the plurality of branches, and the inductor and the capacitor that are connected in series are disposed on at least one branch. In a structure shown in FIG. 4, a manner in which the inductor and the capacitor are disposed in series on one circuit is used. It should be understood that the configuration manner of the inductor and the capacitor may be changed based on an actual requirement, and is not limited to the structure shown in FIG. 4.

FIG. 5 shows a manner in which the ground point 30 is connected to the reference element in series. In this antenna, the ground point 30 is connected to a plurality of branches connected in parallel, an inductor or a capacitor or a capacitor is disposed on each branch, and each branch is grounded. The second metal section 22 is selectively connected to one branch of the matching circuit 80. The electrical length path from the ground point 30 to the second metal section 22 is changed by connecting a plurality of branches to the ground point 30 in series. In one embodiment, during configuration, the ground point 30 is first connected to the plurality of branches in parallel, and then the branch is connected to the second metal section 22. In addition, during connection, the inductor and the capacitor that are connected in series are at least disposed on each branch. When an electric charge flows through the components, the electrical length path is changed. Therefore, the electrical length path from the ground point 30 to the second metal section 22 may be changed by the disposed inductor, capacitor, or a combination of the inductor and the capacitor. During configuration, components of different parameters are disposed on a plurality of branches, and each branch is selectively connected to the ground point 30 or the second metal section 22. In one embodiment, as shown in FIG. 5, a switch is disposed on each branch, and the second metal section 22 is connected to the ground point 30 through one of the branches by switching on or off the switch. A single-pole multi-throw switch may be alternatively used. In this case, a non-movable end of the single-pole multi-throw switch is connected to the second metal section 22, and a movable end is connected to the branch. By using the single-pole multi-throw switch, one branch is selected for grounding. In one embodiment, the adjusting circuit 80 is disposed on a second conductor 23. In one embodiment, one end of the adjusting circuit 80 is grounded and the other end is connected to the second conductor 23. The other end of the second conductor 23 is connected to the second metal section 22.

The reference element may be the inductor, the capacitor, or a circuit of the inductor and the capacitor that are connected in series. As shown in FIG. 5, a different inductor is disposed on each of the plurality of branches, and the capacitor that is connected in series to the inductor is disposed on at least one branch. In a structure shown in FIG. 5, a manner in which the inductor and the capacitor are disposed in series on one circuit is used. It should be understood that the configuration manner of the inductor and the capacitor may be changed based on an actual requirement, and is not limited to the structure shown in FIG. 5.

The electrical length path from the ground point 30 to the second metal section 22 is changed by using different manners shown in FIG. 4 and FIG. 5, thereby changing a location of a maximum electric field point.

In this manner, the feed point 10 and the ground point 30 may be respectively located on two sides of a central line of the second metal section 22. In one embodiment, the feed point 10 and the ground point 30 are respectively located on the two sides of the central line of the second metal section 22 in a symmetric manner.

In addition, when the adjusting circuit 80 is used, the adjusting circuit 80 may alternatively be disposed on the first conductor 21. In other words, the electrical length path from the feed point 10 to the second metal section 22 is changed by using the adjusting circuit 80.

Embodiment 3

Referring to FIG. 3, FIG. 4, and FIG. 5, in this embodiment, solutions in Embodiment 1 and Embodiment 2 are both used. In one embodiment, both the electrical length path from the feed point 10 to the second metal section 22 and the electrical length path from the ground point 30 to the second metal section 22 are changed. In addition, during configuration, the reference element and lengths of the first conductor 21 and the second conductor 23 are designed, so that the electrical length path from the ground point 30 to the second metal section 22 is not equal to the electrical length path from the feed point 10 to the second metal section 22.

Embodiment 4

Figure 6:
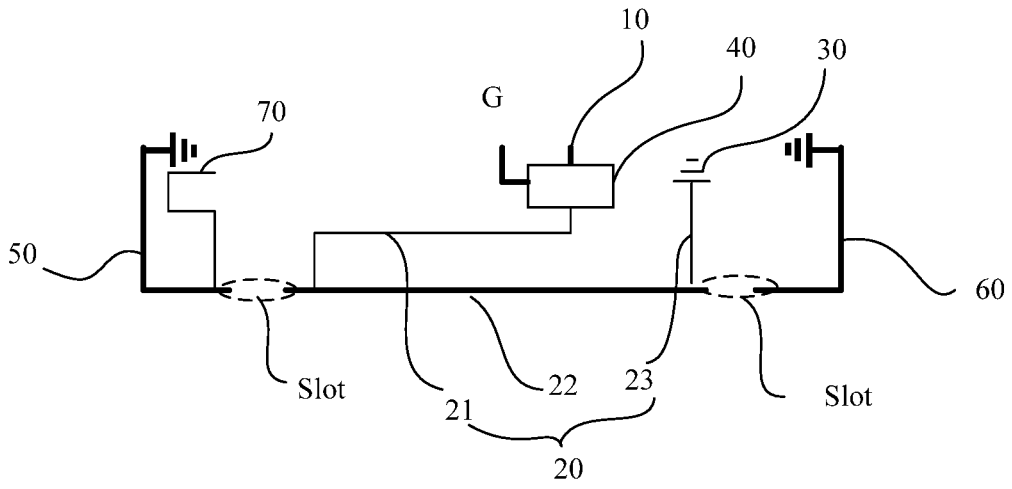
FIG. 6 is a schematic structural diagram of another antenna according to an embodiment of this application.

As shown in FIG. 6, the antenna further includes a parasitic element in addition to the structure shown in Embodiment 3. During configuration, the parasitic element may include the first metal section 50 or the third metal section 60 that is grounded. A resonance frequency produced by the parasitic element may be regulated by changing a location of the ground point. The parasitic element may alternatively include the first metal section 50 or the third metal section 60 and a metal patch 70 that is connected to a slot endpoint (the slot endpoint is an end of the metal section that is close to a slot). A resonance location of the parasitic element is determined by both the location of the ground point and a length of the metal patch 70. The metal patch 70 is a flexible circuit board, a metal conductive plate, a laser layer, or a thin-layer conductor during preparation. As shown in FIG. 6, in this case, the metal patch 70 is located on the first metal section 50, and is located at an end of the first metal section 50 that is close to the slot. In addition, the metal patch 70 may alternatively be disposed at an end of the third metal section 60 that is close to the slot. It should be understood that disposed locations of the feed point 10 and the ground point 30 in FIG. 6 are only an example, and the ground point 30 and the feed point 10 may alternatively be disposed in a manner different from that shown in FIG. 6.

During configuration, there is a bend structure on a top of the metal patch 70, the bend forms a U-shape bezel with an opening, and the opening of the U-shape bezel faces toward the location of the feed point 10.

The parasitic element is added to a loop antenna, to improve flexibility of high-frequency tuning of the antenna. Particularly, when a wire of a metal bezel of the antenna is fixed, the parasitic element may effectively improve bandwidth and radiating efficiency of the loop antenna in intermediate and high frequencies.

Embodiment 5

Figure 7:
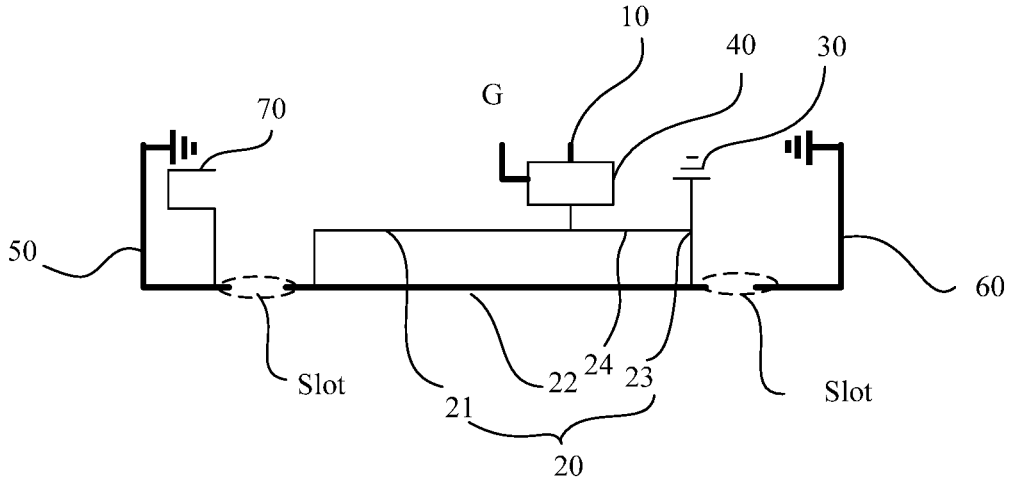
FIG. 7 is a schematic structural diagram of another antenna according to an embodiment of this application.

As shown in FIG. 7, the radiating element 20 provided in this embodiment further includes a third conductor 24, in addition to the second metal section 22, the first conductor 21, and the second conductor 23 included in the foregoing embodiments, and two ends of the third conductor 24 are connected to the first conductor 21 and the second conductor 23, respectively. In this case, the first conductor 21, the second metal section 22, the second conductor 23, and the third conductor 24 form a loop. In this way, a current from the feed point 10 flows through the first conductor 21 to the second metal section 22, and a current from the ground point flows through the third conductor 23 to the second metal section 22. A configuration manner in this embodiment may be applied to Embodiment 1 to Embodiment 4. In other words, the third conductor 23 may be added to the structure of the radiating element 20 in Embodiment 1 to Embodiment 4.

During configuration, the third conductor 24 is a flexible circuit board, a metal conductive plate, a laser layer, or a thin-layer conductor.

Figure 8A:
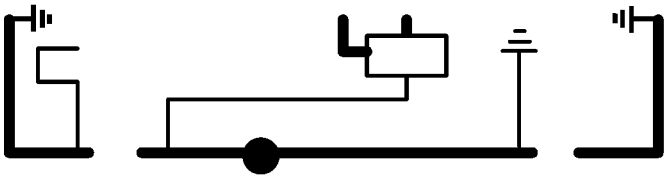
FIG. 8*a* to FIG. 8*d* are schematic diagrams of distribution of maximum electric-field values in modals with different frequency bands for the antenna shown in FIG. 6.
Figure 8B:
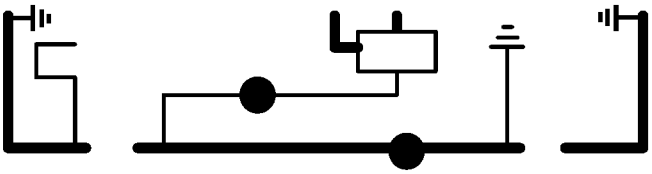
Figure 8C:
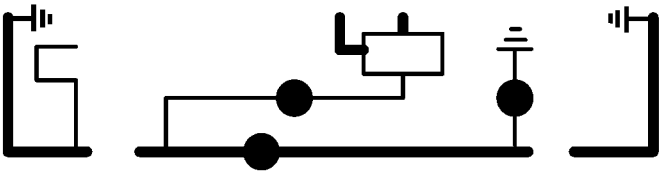
Figure 8D:
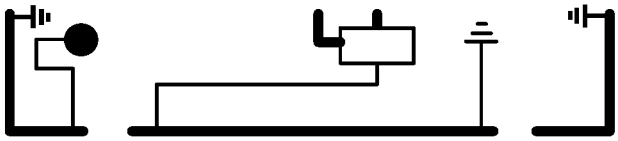

For easy understanding of an antenna provided in this embodiment, the following uses the structure shown in FIG. 6 as an example to perform emulation processing in different modals. Refer to FIG. 8*a* to FIG. 8*d*. FIG. 8*a* is a schematic diagram of distribution of a maximum electric-field value in a half wavelength modal in this application, FIG. 8*b* is a schematic diagram of distribution of a maximum electric-field value in one wavelength modal, FIG. 8*c* is a schematic diagram of distribution of a maximum electric-field value in a 3/2 modal, and FIG. 8*d* is a schematic diagram of distribution of a maximum electric-field value in a resonant modal of a parasitic element. A solid circle represents a maximum electric field point. It can be learned from FIG. 8*a*, FIG. 8*b*, FIG. 8*c*, and FIG. 8*d* that when the foregoing structure is used for the antenna in this application, in different modes, the maximum electric field point is far away from a slot, thereby overcoming the following two problems related to an antenna of a mobile terminal in the prior art: (a) Antenna load is relatively large, and a radiating hole is small, causing poor bandwidth and radiating efficiency. This is even more serious in a case of a large screen-to-body ratio and small headroom. (b) A large electric-field area is relatively close to a hand, and impact of the hand on the antenna is relatively large. Therefore, the antenna effect is improved.

In addition, this application further provides a mobile terminal. The mobile terminal may be a common mobile terminal device, such as a mobile phone or a tablet computer. In addition, the mobile terminal device has a metal bezel, and at least two slots are disposed in the metal bezel, thereby dividing the metal bezel into a plurality of metal sections that are insulated from each other. In one embodiment, two slots are disposed in the metal bezel, and the two slots divide the metal bezel into a first metal section 50, a second metal section 22, and a third metal section 60 that are insulated from each other. The mobile terminal further includes the antenna according to any one of the foregoing embodiments.

In the foregoing technical solutions, a connection structure between the feed point 10 or the ground point 30 and the second metal section 22 is changed, so that the electrical length path of the current from the feed point 10 to the second metal section 22 is not equal to the electrical length path of the current from the ground point 30 to the second metal section, and the maximum electric field point is far away from a slot of the metal bezel, thereby reducing impact of a hand on an electric field in a modal, and improving performance of the antenna.

Obviously, persons skilled in the art can make various modifications and variations to the embodiments of this application without departing from the spirit and scope of this application. This application is intended to cover these modifications and variations provided that they fall within the scope defined by the claims of this application and their equivalent technologies.

What is claimed is:

1. An antenna of a mobile terminal, wherein the mobile terminal includes a metal bezel comprising at least two slots disposed in the metal bezel, the two slots dividing the metal bezel into a first metal section, a second metal section, and a third metal section, and the antenna comprises:

a radiating element, a matching network, a feed point, and a ground point, wherein the radiating element comprises the second metal section located between the two slots, a first conductor, and a second conductor; the first conductor is connected to one end of the second metal section, and a connection point between the first conductor and the second metal section is a feed contact point; the second conductor is connected to the other end of the second metal section, and a connection point between the second conductor and the second metal section is a ground contact point; and a vertical distance between the feed point and the ground point is less than a vertical distance between the feed contact point and the ground contact point;

the feed point is connected to the first conductor by the matching network;

the ground point is connected to the second conductor; and an electrical length path of current from the feed point to the second metal section is not equal to an electrical length path of current from the ground point to the second metal section, wherein the electrical length path of current from the feed point to the second metal section is substantially longer than the electrical length path of current from the ground point to the second metal section.

2. The antenna of the mobile terminal according to claim 1, wherein the feed point and the ground point are located on one side of a central line, and the central line is a central line perpendicular to a length direction of the second metal section, among central lines of the second metal section.

3. The antenna of the mobile terminal according to claim 1, further comprising an adjusting circuit located between the ground point and a feeder, wherein the adjusting circuit comprises a plurality of parallel branches, an inductor or a capacitor is disposed on each branch, and each branch is grounded; and the second metal section is selectively connected to one branch of the adjusting circuit.

4. The antenna of the mobile terminal according to claim 3, wherein an inductor and a capacitor that are connected in series are disposed on at least one branch.

5. The antenna of the mobile terminal according to claim 1, wherein an adjusting circuit is disposed in the second conductor, the adjusting circuit comprises a plurality of parallel branches, an inductor or a capacitor is disposed on each branch, and each branch is connected to the ground point; and the second metal section is selectively connected to one branch of the adjusting circuit.

6. The antenna of the mobile terminal according to claim 3, wherein an inductor and a capacitor connected in series are disposed on at least one branch.

7. The antenna of the mobile terminal according claim 1, further comprising at least one parasitic element.

8. The antenna of the mobile terminal according to claim 7, wherein the parasitic element is the first metal section, or the third metal section, or the first metal section and a metal patch disposed at a slot endpoint of the first metal section, or the third metal section and a metal patch disposed on a slot endpoint of the third metal section.

9. The antenna of the mobile terminal according to claim 1, wherein the first conductor is a flexible circuit board, a metal conductive plate, a laser layer, or a thin-layer conductor.

10. The antenna of the mobile terminal according to claim 1, further comprising a third conductor, wherein two ends of the third conductor are respectively connected to the first conductor and the second conductor.

11. A mobile terminal comprising:

a metal bezel including at least two slots disposed in the metal bezel, the two slots dividing the metal bezel into a first metal section, a second metal section, and a third metal section that are insulated from each other; and an antenna, wherein the antenna comprises a radiating element, a matching network, a feed point, and a ground point, wherein the radiating element comprises the second metal section located between the two slots, a first conductor, and a second conductor; the first conductor is connected to one end of the second metal section, and a connection point between the first conductor and the second metal section is a feed contact point; the second conductor is connected to the other end of the second metal section, and a connection point between the second conductor and the second metal section is a ground contact point; and a vertical distance between the feed point and the ground point is less than a vertical distance between the feed contact point and the ground contact point;

the feed point is connected to the first conductor by the matching network;

the ground point is connected to the second conductor; and an electrical length path of current from the feed point to the second metal section is not equal to an electrical length path of current from the ground point to the second metal section, wherein the electrical length path of current from the feed point to the second metal section is substantially longer than the electrical length path of current from the ground point to the second metal section.

12. The mobile terminal according to claim 11, wherein the feed point and the ground point are located on one side of a central line, and the central line is a central line perpendicular to a length direction of the second metal section, among central lines of the second metal section.

13. The mobile terminal according to claim 11, further comprising an adjusting circuit located between the ground point and a feeder, wherein the adjusting circuit comprises a plurality of parallel branches, an inductor or a capacitor is disposed on each branch, and each branch is grounded; and the second metal second is selectively connected to one branch of the adjusting circuit.

14. The mobile terminal according to claim 13, wherein an inductor and a capacitor that are connected in series are disposed on at least one branch.

15. The mobile terminal according to claim 11, wherein an adjusting circuit is disposed in the second conductor, the adjusting circuit comprises a plurality of parallel branches, an inductor or a capacitor is disposed on each branch, and each branch is connected to the ground point; and the second metal section is selectively connected to one branch of the adjusting circuit.

16. The mobile terminal according to claim 15, wherein an inductor and a capacitor connected in series are disposed on at least one branch.

17. The mobile terminal according to claim 11, further comprising at least one parasitic element.

18. The mobile terminal according to claim 17, wherein the parasitic element is the first metal section, or the third metal section, or the first metal section and a metal patch disposed at a slot endpoint of the first metal section, or the third metal section and a metal patch disposed on a slot endpoint of the third metal section.

19. The mobile terminal according to claim 11, wherein the first conductor is a flexible circuit board, a metal conductive plate, a laser layer, or a thin-layer conductor.

20. The mobile terminal according to claim 11, further comprising a third conductor, wherein two ends of the third conductor are respectively connected to the first conductor and the second conductor.

* * * * *